US005127478A

United States Patent [19]

Miller

[11] Patent Number: 5,127,478

[45] Date of Patent: Jul. 7, 1992

[54] CASING SUSPENSION SYSTEM

[75] Inventor: Jack E. Miller, Houston, Tex.

[73] Assignee: National-Oilwell, Houston, Tex.

[21] Appl. No.: 753,013

[22] Filed: Aug. 23, 1991

Related U.S. Application Data

[63] Continuation of Ser. No. 423,140, Oct. 18, 1989.

[51] Int. Cl.[5] ..... E21B 43/013

[52] U.S. Cl. ..... 166/348; 166/208; 285/141

[58] Field of Search ..... 166/348, 207, 208, 214, 166/217; 285/141, 320

[56] References Cited

U.S. PATENT DOCUMENTS

| | | | |
|---|---|---|---|
| 3,374,836 | 3/1968 | Gribbin | 166/214 X |
| 3,424,244 | 1/1969 | Kinley | 166/207 X |
| 3,741,589 | 6/1973 | Herd et al. | 285/141 X |
| 3,918,747 | 11/1975 | Putch | 285/141 X |
| 4,139,059 | 2/1979 | Carmichael | 166/208 |
| 4,232,889 | 11/1980 | Putch | 285/141 |
| 4,276,932 | 7/1981 | Saliger et al. | 166/214 |
| 4,295,665 | 10/1981 | Pierce | 285/141 X |
| 4,355,825 | 10/1982 | Leicht | 166/217 X |
| 4,422,507 | 12/1983 | Reimert | 285/141 X |
| 4,468,055 | 8/1984 | Reimert | 285/141 |
| 4,509,594 | 4/1985 | Milberger et al. | 166/208 |
| 4,569,404 | 2/1986 | Milberger et al. | 175/208 |
| 4,730,851 | 3/1988 | Watts | 285/141 X |
| 4,757,860 | 7/1988 | Reimert | 166/208 |
| 4,773,477 | 9/1988 | Putch | 166/208 X |
| 4,852,647 | 8/1989 | Mohaupt | 166/214 X |
| 4,886,121 | 12/1989 | Denny et al. | 166/208 X |

FOREIGN PATENT DOCUMENTS

| | | |
|---|---|---|
| 0261909 | 9/1987 | European Pat. Off. . |
| 2120300 | 11/1983 | United Kingdom . |
| 2129852 | 5/1984 | United Kingdom . |
| 2156404 | 10/1985 | United Kingdom . |

*Primary Examiner*—William P. Neuder
*Attorney, Agent, or Firm*—David A. Rose

[57] ABSTRACT

The casing suspension system includes a hanger having a load transfer mechanism and a finding/latching mechanism for finding, latching, and transferring load to an outer casing. The load transfer mechanism includes a ring disposed within a reduced diameter portion around the hanger. The ring includes a plurality of load bearing elements extending downwardly with the load bearing elements having a plurality of external teeth. The load bearing elements include an upwardly facing convex annular shoulder which engages a mating downwardly facing concave annular shoulder on the hanger. A spring retainer is disposed around the lower end of the load bearing elements to bias the load bearing elements inwardly. The hanger also includes a spring tube disposed below the load transfer ring. The spring tube includes a plurality of integral gates having keys. As the hanger is lowered into the well, the spring retainer maintains the load bearing elements in the "in" position. Once the keys on the spring tube engage a profile in the outer casing, the load transfer ring moves downwardly with respect to the spring tube causing the spring tube to wedge the load bearing elements in the "out" position into engagement with the outer casing.

22 Claims, 6 Drawing Sheets

CASING SUSPENSION SYSTEM

This is a continuation of copending application Ser. No. 07/423,140 filed On Oct. 18, 1989.

BACKGROUND OF THE INVENTION

This invention relates to casing suspension systems and more particularly to a mudline suspension system having a load transfer mechanism and a latching mechanism to connect an inner casing hanger to an outer casing for suspending casing subsea.

The subsea exploration of oil and gas reserves includes suspending a plurality of concentric strings of casing within the bore of the well. To suspend the strings of casing using a mudline suspension system, a series of hangers to which the casing strings are connected are stacked and supported within a conductor casing located at the mudline. The conductor casing extends from the mudline to a surface wellhead and blow-out preventer and through which the drilling equipment is raised and lowered during the drilling and completion of the well. In the installation of successive casing strings within the well, a hanger assembly suspending the casing string is lowered through the conductor casing for suspension within the outer casing. Upon reaching location, the hanger assembly must be properly located within the outer casing and the weight of the casing string transferred to the outer casing.

The load transfer mechanism of the inner casing hanger must contract to a diameter that will allow the inner casing hanger to be lowered through the string of conductor casing. Once the inner casing hanger reaches a predetermined location within the previously installed outer casing at the mudline, the load transfer mechanism expands and forms a connection between the inner hanger and outer casing. Further, the load transfer mechanism cannot block fluid flow through the annulus between the two casing strings, particularly during the cementing operation, and thus the suspension system must provide a flow-by area.

Various U.S. patents disclose load transfer and latching mechanisms. U.S. Pat. No. 4,730,851 discloses a hanger assembly suspended within an outer casing. The hanger assembly includes a hanger body with an expandable locking assembly comprised of a plurality of latching fingers secured at their lower ends about the hanger body by a split retainer ring. The split retainer ring permits limited pivotal movement of the latching fingers about their lower ends. The upper end of each latching finger has a hook which engages an upwardly facing shoulder on the inner profile of the outer casing. The free ends of the latching fingers are urged outwardly by a circular spring. The retainer and locking assembly are secured to the hanger body by a connecting shear ring which restrains relative axial movement of the locking assembly until the latching fingers hook on the inner profile of the outer casing whereby the shear ring is sheared by the weight of the inner casing string.

U.S. Pat. No. 3,741,589, in FIGS. 1–6, illustrates a hanger body having a reduced diameter midportion, a slightly larger diameter locking portion, and upper and lower stop shoulders. The lower stop shoulder includes a rim and a lip. A support ring, axially split along one side, is disposed around the reduced diameter portion. Ring 30 also includes a lower projecting lip which cooperates with the rim lip to initially hold the ring in the retracted position. The ring also includes lower guide segments having a cam surface. As the hanger is lowered into the casing, the camming surface retracts the ring such that the lips become disengaged. This allows the ring to move upwardly relative to the hanger body until the guide segments and support segments of the ring encounter the recesses in the wellhead and spring outwardly to engage those surfaces to support the hanger within the wellhead. The backup portion maintains the lock ring in the supporting position. FIGS. 7–11 disclose a latch release assembly which includes a carrier and an elongate releasing latch. The releasing latch rides in a slot in the carrier and pivots about the pin. A leaf spring is attached to the latch to bias the latch outwardly. As the hanger assembly is lowered through the blowout preventer and surface equipment, the rounded leading edge of the latch cams the latch inwardly. Upon the latch engaging the recesses in the wellhead, the casing weight shears the pins to permit the hanger body to continue to move downwardly and allow the suspension ring to expand into the recesses.

Other patents having load and latch mechanisms include U.S. Pat. Nos. 3,918,747; 4,232,889; 4,276,932; 4,295,665; 4,355,825; 4,422,507; 4,468,055; 4,509,594; 4,569,404; and 4,757,860.

Prior art load transfer mechanisms are formed of split, or colleted rings that expand into the outer casing by means of a radial sliding motion. This radial motion may also include an axial motion as well. Most prior art latching mechanisms expand virtually the same distance in the radial direction along the entire axial length of the split load transfer ring or portion of the ring. In some inner and outer casing assemblies, the annulus containing the load transfer mechanism in its contracted position is not much larger than the radial expansion required to form the connection to the outer casing. In such prior art designs, the load bearing "contact patch" between the load transfer mechanism and the inner casing may diminish during radial expansion to the extent that the load carrying capacity of the inner casing is limited by high contact stresses between the split load transfer ring and the inner casing as opposed to being limited by other factors. Also, the required flow-by area is typically fulfilled in a portion of the annulus vacated by the split load transfer ring. A fine balance must be struck between flow-by area, load carrying capacity (size of the contact patch), and strength of the inner hanger body itself. The radial translation required to connect the inner hanger and outer casing becomes a key to how well these factors are balanced.

The inner hanger assembly must also include a means for finding the proper location within the outer casing for locating the inner hanger and for activating the load transfer mechanism. In prior art designs, a profile is provided in the bore of the outer casing to provide the precise location for the inner casing hanger and to allow for the activation of the load transfer mechanism so that the inner casing hanger, and associated casing string, may be suspended from the outer casing. It is often the case that the previously installed outer casing, and its profile to be located and interfaced by the inner hanger, is contaminated with cement or other residue as a result of the drilling and cementing operations. When such contamination exists, it may not be possible for the inner casing hanger to "find location" and subsequently form the desired interface. "Finding location" and successively "latching in" is a critical operational step in mudline suspension systems. Prior art mechanisms only incorporate a single split ring or colleted ring which must expand into the recess of the profile in the outer casing.

The present invention overcomes these deficiencies of prior art mudline suspension systems.

SUMMARY OF THE INVENTION

The present invention includes a hanger assembly for suspending at the mudline a string of casing within an outer casing. The hanger assembly includes a generally tubular hanger having a reduced diameter portion forming a downwardly facing concave annular shoulder. A plurality of circumferentially spaced lugs project radially outward from within said reduced diameter portion. A load transfer ring is disposed within the reduced diameter portion around the tubular hanger for transferring the load from the hanger to the outer casing. The load transfer ring includes an upwardly facing convex annular shoulder which engages the downwardly facing concave annular shoulder on the tubular hanger. The load transfer ring further includes a plurality of load bearing elements having a plurality of external teeth. A spring retainer is received in a groove around the lower end of the load transfer ring to bias the load bearing elements radially inward into the reduced diameter portion of the hanger.

The hanger assembly further includes a spring tube reciprocally disposed in the reduced diameter portion below the load transfer ring for finding the outer casing and latching the spring tube within the outer casing. The spring tube includes a plurality of integral gates circumferentially disposed therearound. The gates are formed by generally U-shaped apertures in the tubular sides of the spring tube with that portion of the gate integral with the spring tube forming a support base for each of the gates. A key is disposed on the free end of each of the gates opposite the support base. A plurality of fingers extend downwardly from the lower end of the spring tube with each of the fingers having at least one tooth extending radially inward for reception in a groove in the hanger. The upper periphery of the spring tube has a wedge angle for engaging the load bearing elements of the load transfer ring so as to act as an actuation piston upon latching the spring tube in the profile of the outer casing and causing the load transfer ring to move downwardly with respect to the spring tube.

As the hanger assembly is lowered into the well, the spring retainer maintains the load bearing elements in the inward and non-load transfer position. Once the latches on the spring tube engage the profile of the outer casing and the gates force the keys into the profile, the continued downward movement of the load transfer ring with respect to the spring tube causes the wedging surface of the spring tube to act as a piston and bias the load bearing elements outwardly. As the load bearing elements move outwardly, the convex shoulder of the load transfer ring articulates in the concave shoulder of the reduced diameter portion of the hanger until the teeth of the load bearing elements become engaged in the profile of the outer casing to transfer the load of the hanger and casing string to the outer casing.

The load transfer ring of the present invention operates utilizing a rotational degree of freedom about the major load bearing convex/concave surfaces in order to connect the hanger to the outer casing. Virtually all prior art systems utilize a translational degree of freedom. The advantage of the present invention is that a relatively large unchanging bearing surface is maintained between the expanding load transfer ring and the body of the hanger even while the load transfer ring is expanded outwardly to connect the inner hanger to the outer casing. The pure radial translation of the load transfer ring to achieve this connection using prior art systems causes a decrease in bearing surface and thus a decrease in load bearing capacity as the load transfer ring expands. For the same reasons that the present invention preserves a large bearing surface, the load transfer ring itself may also maintain a greater thickness in the most highly loaded area since radial translations used by the prior art diminishes at locations closer to the interface of the load transfer ring and hanger body. The present invention permits higher load ratings, higher pressure ratings, and greater flow-by areas than have been previously achieved in the industry.

The present invention further utilizes a novel means for finding "location" and initiating the "latch-in". Unlike the prior art split rings for finding location, the present invention utilizes a plurality of discrete keys disposed on gates which are semi-independently sprung. This design provides a more reliable latch-in operation where the profile of the outer casing is contaminated with cement or other debris. The present invention only requires that a few of the keys find location to provide sufficient resistance to initiate the latch-in sequence. These relatively thin, discrete keys also provide a higher average bearing pressure against the contaminated profile, aiding the ability to penetrate any contamination and find the receiving profile of the outer casing. Precautions against premature initiation of latch-in are designed into the present invention by virtue of the discrete lugs on the body of the hanger that prevent upward movement of the latch mechanism until the keys are sufficiently expanded into the receiving profile of the outer casing.

The load transfer ring and finding/latching mechanism are separate units such that each unit may be optimally suited for their respective function as opposed to being compromised due to having overlapping functions. Other features which enhance the reliability and performance of the present invention are extra long lead in distances to find location; the spring tube with the gates and keys are not attached to the load transfer ring so as to insure that the load transfer ring does not prematurely activate as a result of the keys being dislocated while moving down in the outer casing; and the keys and gates allow the hanger to be inserted into the outer casing without the need for external restraint devices or shear pins. In addition, the entire hanger assembly is well-contained and transportable without danger of dislocating parts of the assembly.

Other objects and advantages of the invention will appear from the following description.

BRIEF DESCRIPTION OF THE DRAWINGS

For a detailed description of the preferred embodiment of the invention, reference will now be made to the accompanying drawings wherein.

DESCRIPTION OF THE PREFERRED EMBODIMENT

Figure 1:
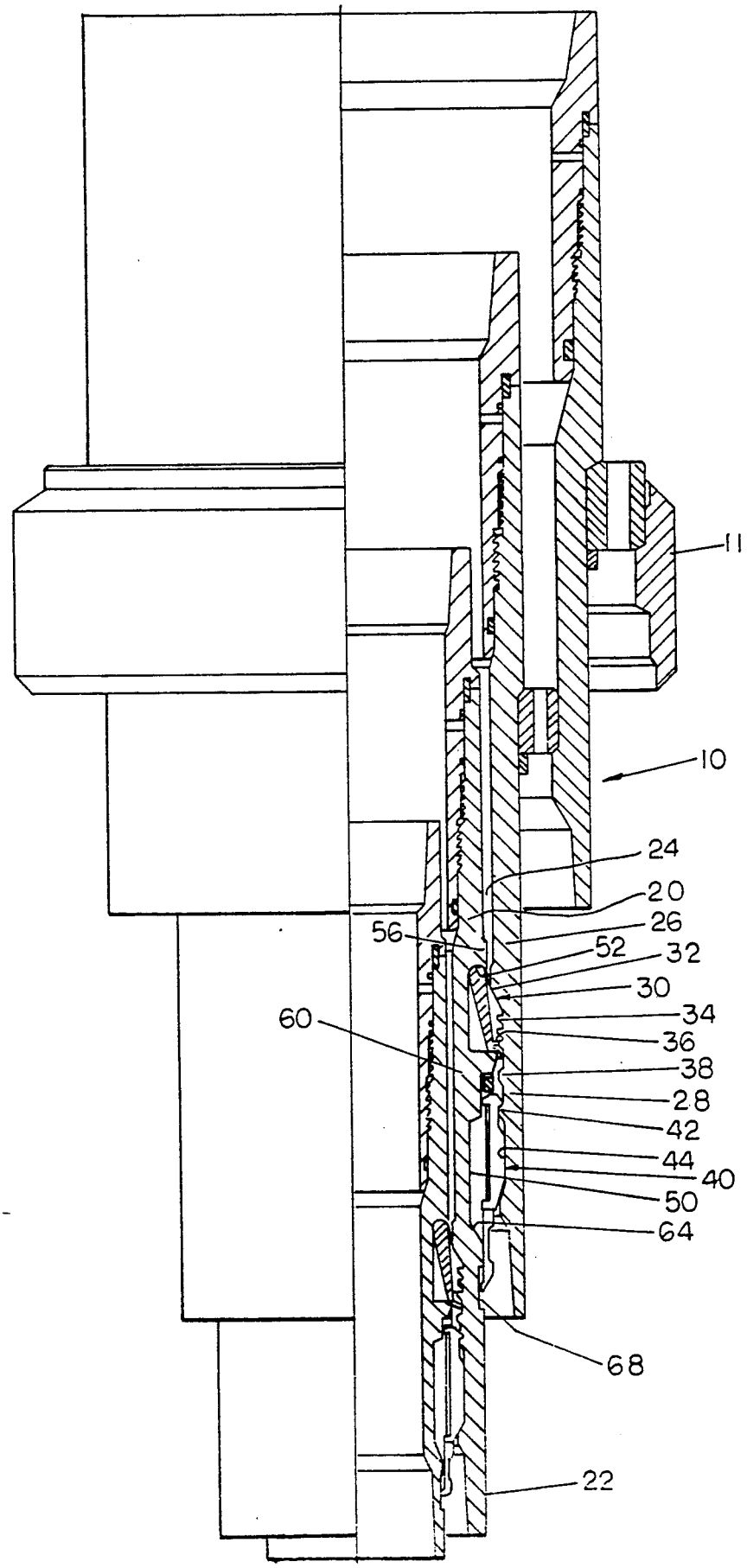
FIG. 1 is a section view of a stack of hanger assemblies suspended within the conductor casing.

Referring initially to FIG. 1, the casing suspension system of the present invention is illustrated generally at 10 and is particularly adapted for installation in a subsea environment near the ocean bottom or mudline. In the drilling of underwater oil and gas wells, a large conductor casing is initially installed in the ocean floor to a suitable depth. Generally a butt weld ring 11 is welded into the conductor casing string at the mudline and the casing extends to the surface. This conductor casing supports one or more casing hangers suspending strings of concentric casing within the bore of the well. The upper end of the casing is adapted for connection to a blowout preventer stack (not shown) and wellhead at the surface and through which the drilling equipment may be raised and lowered during the drilling and completion of the well. As shown in FIG. 1, a series of hangers may be stacked within the conductor casing or subsea wellhead for supporting a plurality of concentric casing strings at the mudline. The casing suspension system 10 includes an inner hanger assembly supported within an outer casing and may be utilized with one or more of the hangers suspending casing within the well. It should be appreciated that the term "outer casing" as used herein refers to any outer member for supporting an inner casing string and may include a subsea wellhead, conductor casing or outer casing hanger. As can be seen, a description of the casing suspension system of the present invention for an inner hanger assembly suspending a particular size casing may equally be applicable to a hanger assembly supporting another size of casing within the wellhead.

The body of the hanger serves several functions. It contains internal pressures, suspends an inner casing string (if any), suspends at its lower end an in-line casing string, and ultimately transfers the suspended casing loads to a load transfer means. The hanger also serves to contain and support other components as well as receive running and tie-back tools.

There are two key functions of the present invention. The first function is to find the subsea appropriate location when running the hanger assembly into the well and reliably latching the hanger assembly within the wellhead. The second function is to have adequate load capacity and flow-by areas at the connection.

FIG. 1 illustrates an inner casing hanger 20 adapted for suspending a string of casing (not shown) at its lower end 22 with the hanger 20 lowered into the bore 24 of an outer casing 26. Outer casing 26, in this example, is a hanger suspending an outer string of casing into the well. Outer casing 26 includes an inner profile 28 for locating and suspending inner casing hanger 20. Inner casing hanger 20 includes a load transfer means 30 for transferring the load from inner hanger 20 to outer casing 26 and a finding/latching means 40 for locating the profile 28 of outer casing 26 in the well and latching the assembly of inner hanger 20 within outer casing 26. As inner hanger 20 is lowered further into the bore 24 of outer casing 26, finding/latching means 40 locates and latches into the profile 28 of outer casing 26 and thereafter becomes an actuation means for actuating load transfer means 30 such that load transfer means 30 engages inner profile 28 and transfers the load from inner hanger 20 and its casing string to outer casing 26.

The profile 28 of outer casing 26 includes an upper annular surface 32 disposed above a plurality of radially extending load supporting teeth 34 adapted for engaging the load transfer means 30 of inner hanger 20. In the preferred embodiment, there are three teeth on profile 28, each having an upwardly facing annular shoulder 36. Each of the teeth 34 have tapered backsides. Profile 28 further includes below teeth 34, a radially extending annular spacer 38 for maintaining the finding/latching means 40 of inner hanger 20 in a non-latching position as hereinafter described. Below spacer 38 is a latching shoulder 42 adapted for engagement with the finding-/latching means 40 as hereinafter described. Below latching shoulder 42 is an enlarged diameter portion 44 having a longitudinal length sufficient to receive the finding/latching means 40 as hereinafter described.

Figure 2:
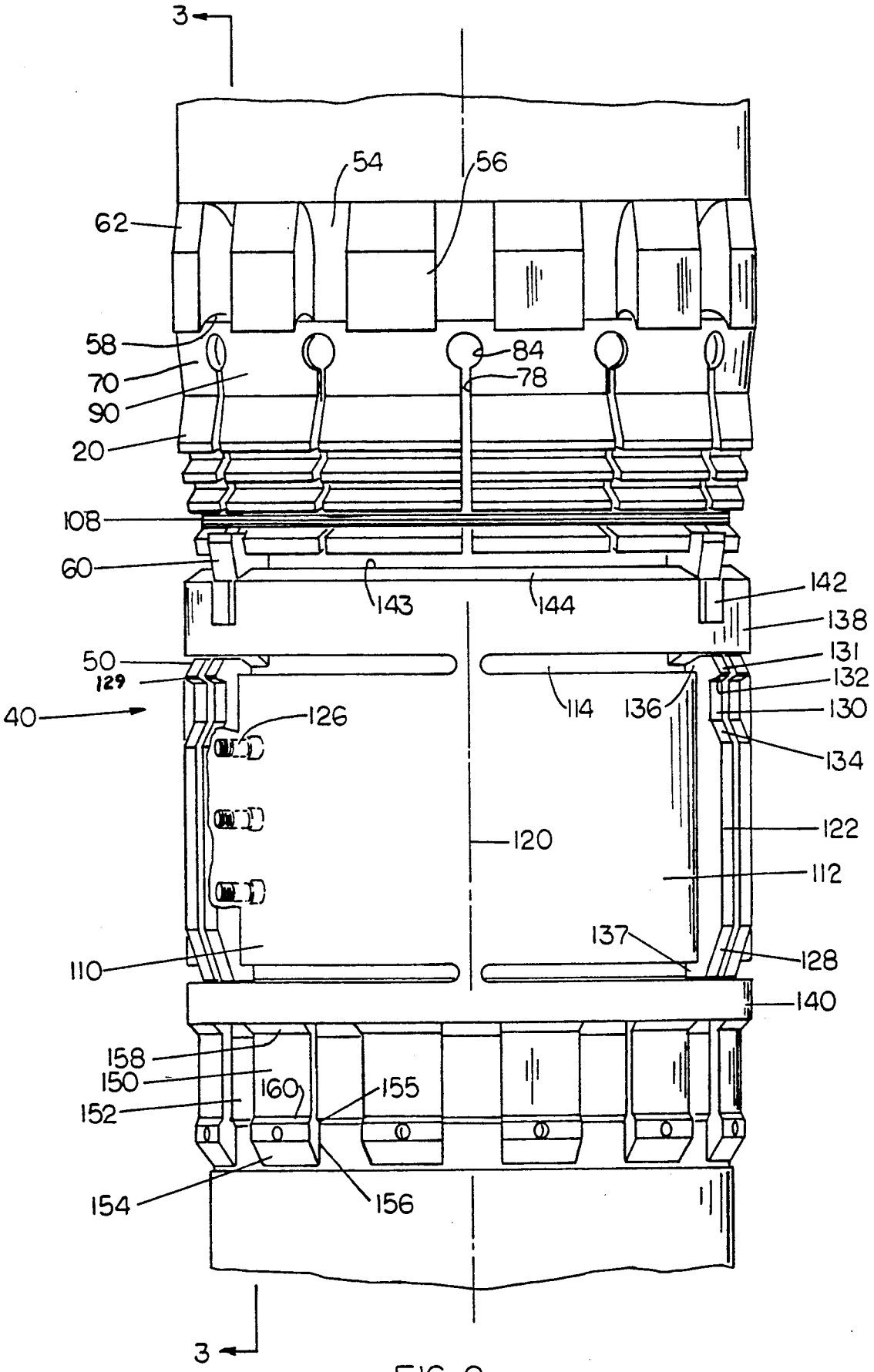
FIG. 2 is an elevation view of the casing suspension system of the present invention.
Figure 3:
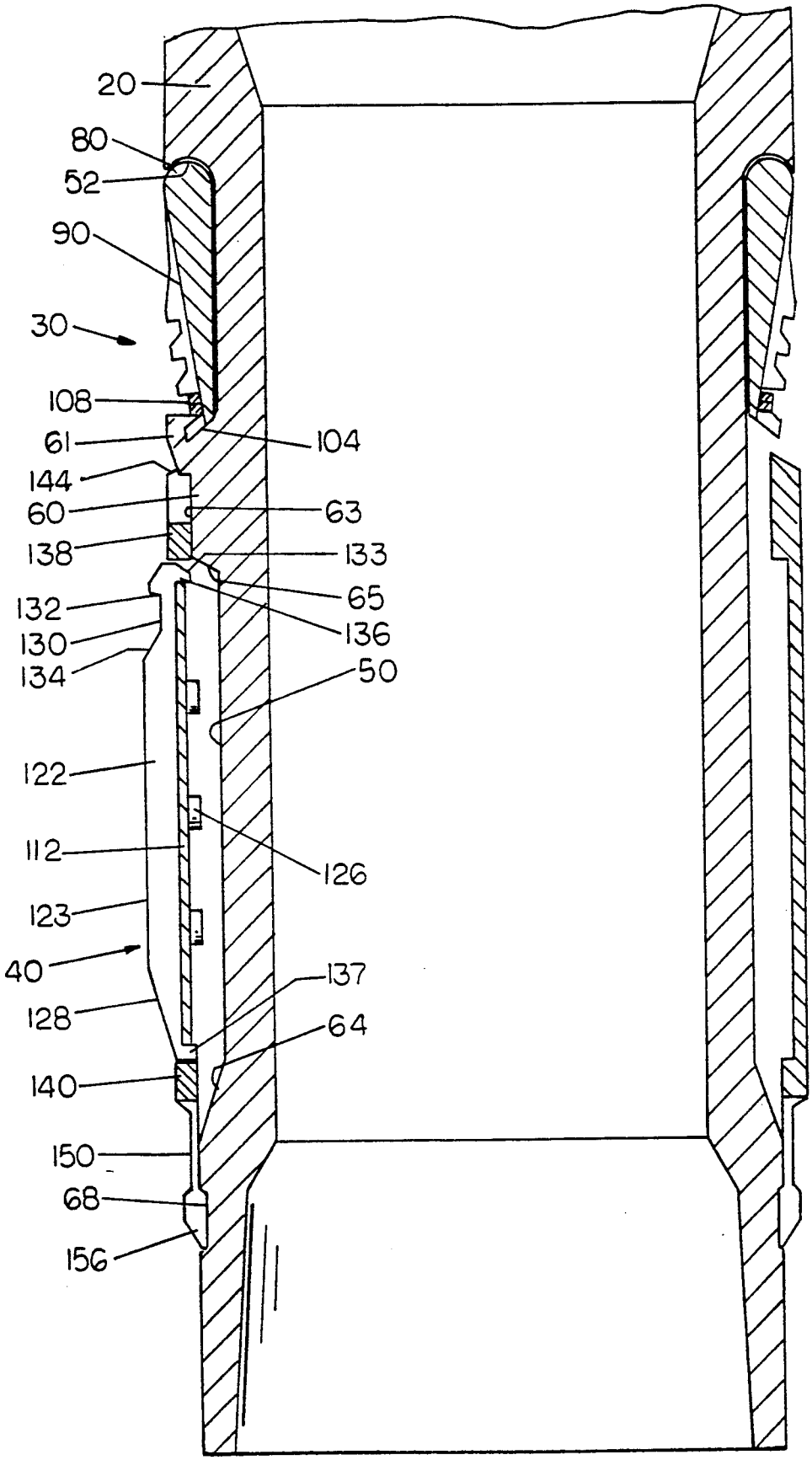
FIG. 3 is a section view at plane 3—3 of the casing suspension system shown in FIG. 2.

Referring now to FIGS. 1-3, the inner hanger 20 includes a reduced diameter portion 50 for housing the load transfer means 30 and the finding/latching means 40. The reduced diameter portion 50 has a plurality of circumferentially spaced flow-by slots 54 at its upper end forming a plurality of shoulder segments 56. Shoulder segments 56 have individual downwardly facing concave bearing surfaces 58 forming a generally annular, downwardly facing concave radius or shoulder 52. All casing loads from internal and in-line casing strings pass through this bearing surface and into the load transfer means 30 on inner hanger 20. Segments 56 may have a slightly larger outer diameter than that of inner hanger 20 with a tapered transition surface 62 therebetween depending upon the design criteria of pressure, tension, and flowby area. At the lower end of reduced diameter portion 50 is a downwardly and outwardly tapering, upwardly facing shoulder 64.

A plurality of lugs 60 are milled and project from the medial portion of reduced diameter portion 50 for the alignment and positioning of the load transfer means 30 and the finding/latching means 40. Lugs 60 include a projecting alignment portion 61, a bearing support surface 63, and a lower downwardly facing cam surface 65. Reduced diameter portion 50 has sufficient depth to adequately receive load transfer means 30 and finding-/latching means 40 so as to permit the passage of hanger assembly 20 through the bore 24 of outer casing 26 with means 30 and 40 in the contracted position. A latch finger locking recess or annular retaining groove 68 is machined into hanger 20 a predetermined distance below reduced diameter portion 50 for receiving a portion of the finding/latching means 40 as hereinafter described.

Figure 4:
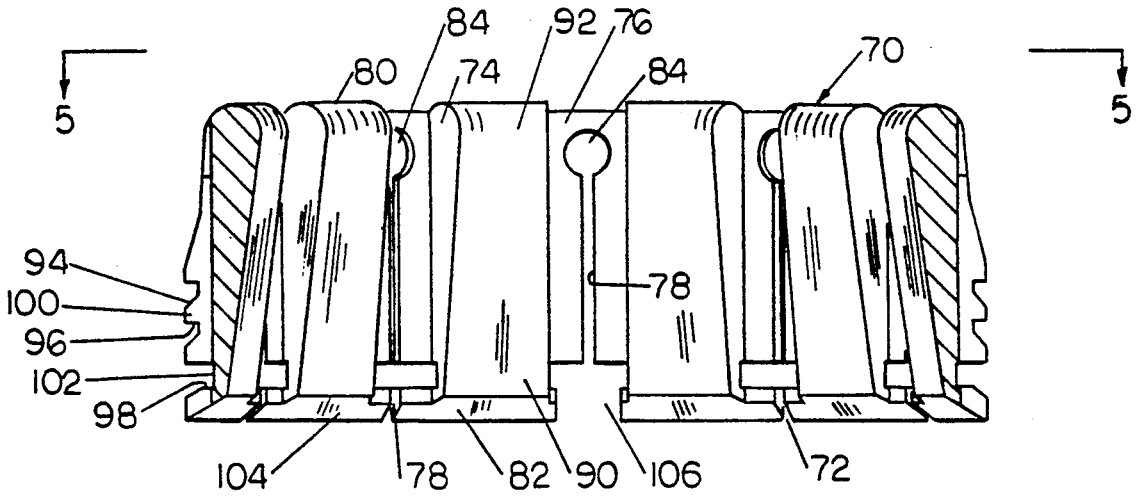
FIG. 4 is an elevation view of the load transfer mechanism showing the casing suspension system of FIG. 2.
Figure 5:
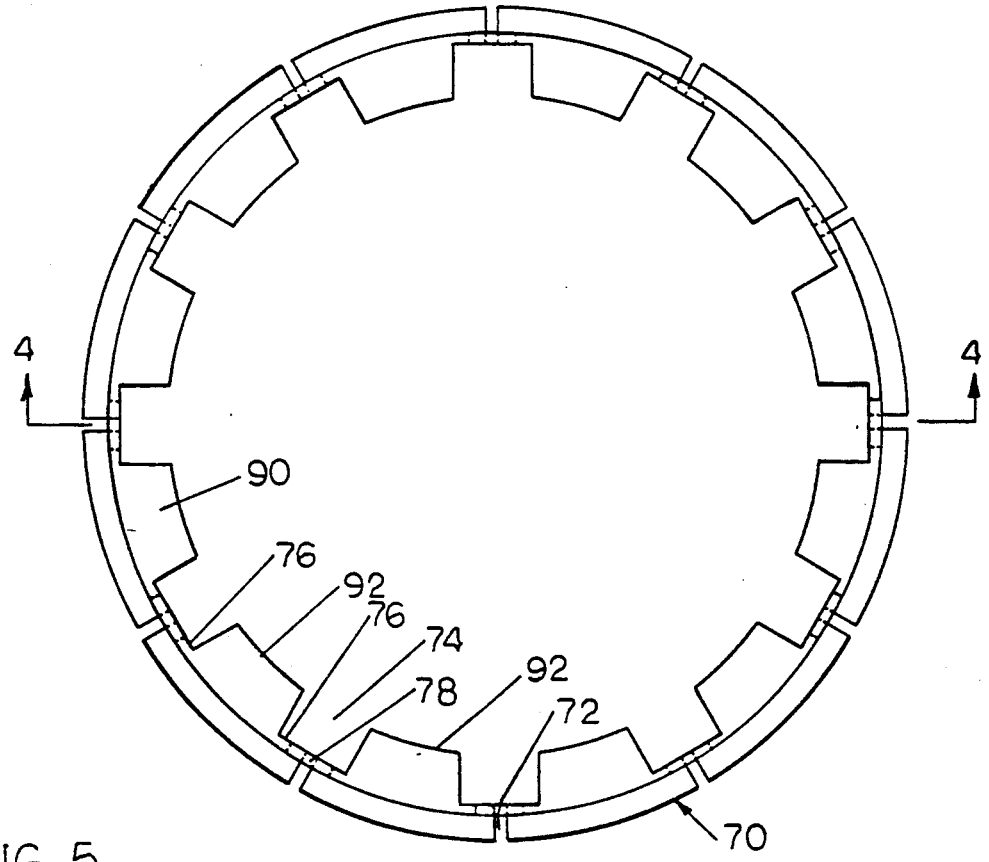
FIG. 5 is a section view at plane 5—5 of the load transfer mechanism of FIG. 4.

Referring now to FIGS. 3 and 4, the load transfer means 30 includes a load transfer ring 70 having a radiused upwardly facing convex annular bearing shoulder 80 for mating engagement with matching downwardly facing concave bearing shoulder 52 on hanger 20. Downwardly facing bearing shoulder 52 and upwardly facing bearing shoulder 80 form a type of hinge connection. Shoulder 80 pivots on shoulder 52 about a center of rotation allowing translational movement of load transfer ring 70. Although the mating bearing surfaces are shown to be concave and convex, the bearing surfaces may have other shapes such as matingly tapered surfaces. Deep axial flow-by slots 74 are milled through the interior of load transfer ring 70 and are evenly spaced along the inner circumference of ring 70 to allow the desired flow-by area for fluid such as encountered during the cementing operation. As a standard configuration, twelve slots 74 are used with a width equal to that provided in the load transfer ring 70. The reduced thickness portion 76 created by flow-by slots 74, includes a slit 78 extending from the lower terminal end 82 of load transfer ring 70 to an aperture 84 adjacent convex shoulder 80. In the standard configuration there are twelve apertures 84, slots 74, and slits 78. Slits 78 are aligned with flow-by slots 74. The large apertures 84 that terminate thin slits 78 make ring 70 more flexible and help prevent breakage through the small remaining section 76 connecting the thick sections 92, while the thin slits 78 allow the ring 70 to expand and contract. If ring 70 is broken adjacent aperture 84, adequate means still exist to control and maintain the remaining elements of load transfer ring 70 in their proper positions so that ring 70 will remain fully functional.

Ring 70 is split for assembly purposes. To install ring 70 onto hanger 20, at least one remaining connected section must be cut through at 72 from a large aperture 84 to the top of the flow slot 74 to allow ring 70 to be expanded for installation.

A plurality of load bearing elements 90 are created by thin slits 78. Load bearing elements 90 include an enlarged thickness midportion 92 juxtaposed between two adjacent reduced thickness portions 76. The enlarged thickness portion 92 includes a backside tapering outwardly from convex shoulder 80 to lower terminal end 82 of ring 70. The load bearing elements 90 are internally tapered to allow the ring 70 to contract inward for running into the outer casing 26. This internal taper is equal to the required activation rotation. Each load bearing element 90 along the length of its outer surface, includes a plurality of load carrying teeth 100 projecting radially outward and adapted for engagement with the load supporting teeth 34 of profile 28. There are preferably three teeth 100 having downwardly and outwardly tapered upwardly facing sides 94 and downwardly facing arcuate shoulder 96 adapted for engagement with shoulder 36 on teeth 34. The load bearing elements 90 have an "in" or contracted position during running when the load bearing elements 90 are received within reduced diameter portion 50, and an "out" or expanded position when load bearing elements 90 are rotated outward and teeth 100 engage teeth 34 on profile 28.

The load transfer ring 70 is machined in the "out" position for several reasons. A perfect mating of the load-bearing surfaces, i.e. teeth 34, 100, on profile 28 and ring 70 can only be obtained by machining ring 70 as if it were in the final latched position. Further, manufacturing of ring 70 is considerably more difficult in the retracted or "in" position since all critical load-bearing surfaces would have to be machined on an angle as well as changing diameters for each individual feature. Also, manufacturing in the out or latched position causes the metal cross section to nominally increase or at least not diminish at locations away from the upper convex radius or shoulder 80, while manufacturing in the retracted or in position would lead to smaller metal sections in these areas, causing lower predicted yield loads. However, manufacturing in the latched position requires the use of a retainer means hereinafter defined, to maintain ring 70 in the contracted position until latch-in.

Referring now to FIGS. 2 and 4, an annular groove 98 is disposed below teeth 100 for receiving a retainer means for retaining load bearing elements 90 in the "in" position. The retainer means preferably includes retainer springs such as two snap rings 108 disposed in annular groove 98 around the lower end of load bearing elements 90. The depth of groove 98 is greater than the thickness of reduced thickness portion 76 such that the bottom 102 of groove 98 is in enlarged thickness portion 92 and will accommodate retainer springs 108. On installation into the receiving groove 98, retainer springs 108 are oriented so that their respective open gaps reside 180° apart to provide a more uniform total radial load, and further, that the lower retainer spring 108 that contacts hanger lug 60 is oriented so that the open gap is halfway between adjacent lugs 60 to prevent a retainer spring 108 from hanging on a lug 60.

A plurality of slots 106 are milled in the lower terminal end 82 of load transfer ring 70 for receiving the projecting alignment portion 61 of lugs 60 projecting from reduced diameter portion 50. Slots 106 are aligned with flow-by slots 74. The slots 106 and lugs 60 index the load bearing elements 90 to allow the spring retainers 108 to rest on lugs 60 thereby vertically retaining load bearing elements 90. By virtue of the mating slots 106 in the load transfer ring 70 which fit around lugs 60, flow-by slots 74 in ring 70 are indexed so that they are always aligned with flow-by slots 54 in inner hanger 20. Three lugs are specified in the standard configuration. The three lugs 60 not only serve to guide and radially locate and centralize the finding/latch means 40 but also serve as backup shoulders for keys 122 thereby supporting gates 112 as hereinafter described.

The lower terminal end 82 of load transfer ring 70 includes a downwardly and outwardly tapered, downwardly facing wedging surface 104 having a preferred wedging angle. The wedging angle of bottom wedging surface 104 incorporates an angle for interface with a matching wedging angle on surface 144 of finding/latching means 40 as hereinafter described. The preferred wedging angle is 30° so that the vertical motion of spring tube 110 will force the lower end of load bearing elements 90 to expand.

Figure 6:
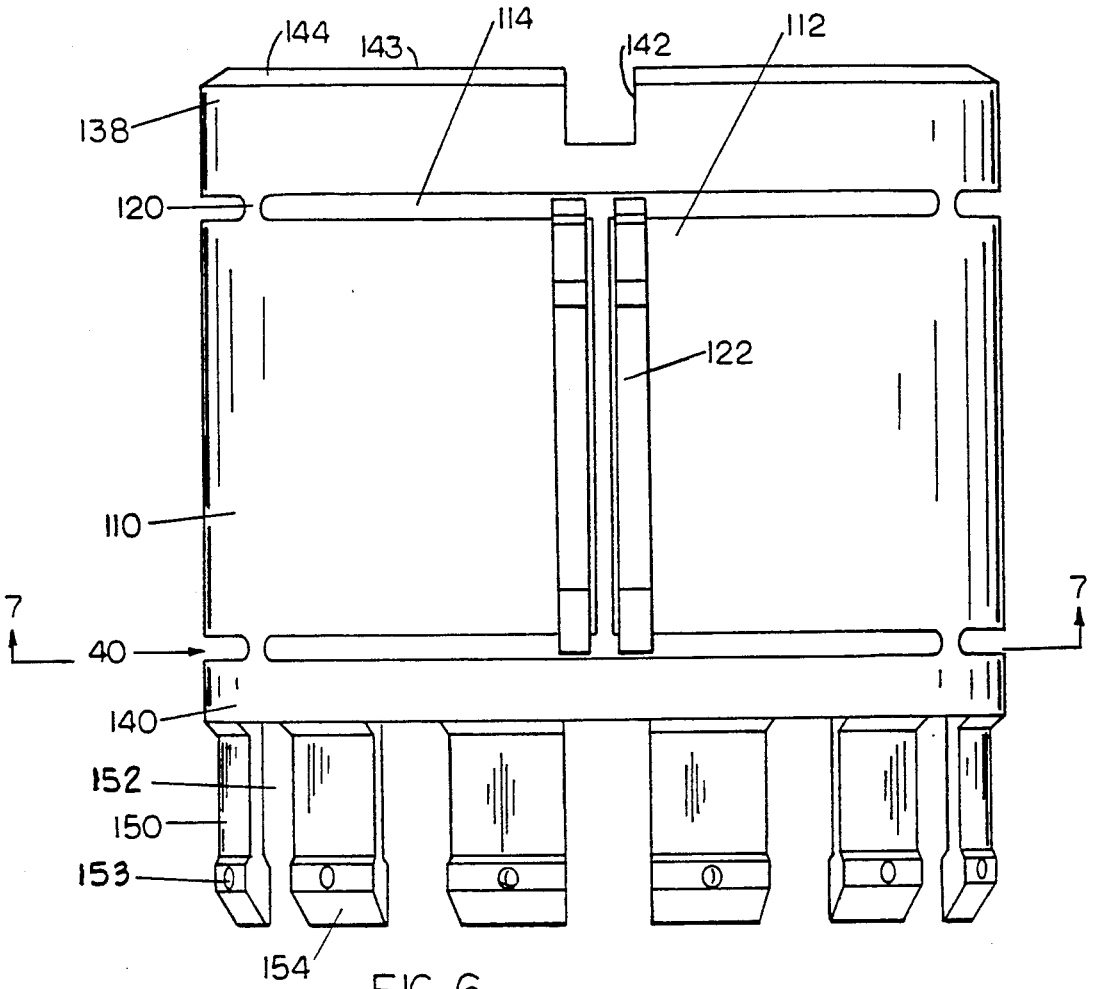
FIG. 6 is an elevation view through the finding-/latching mechanism of the casing suspension system of FIG. 2.
Figure 7:
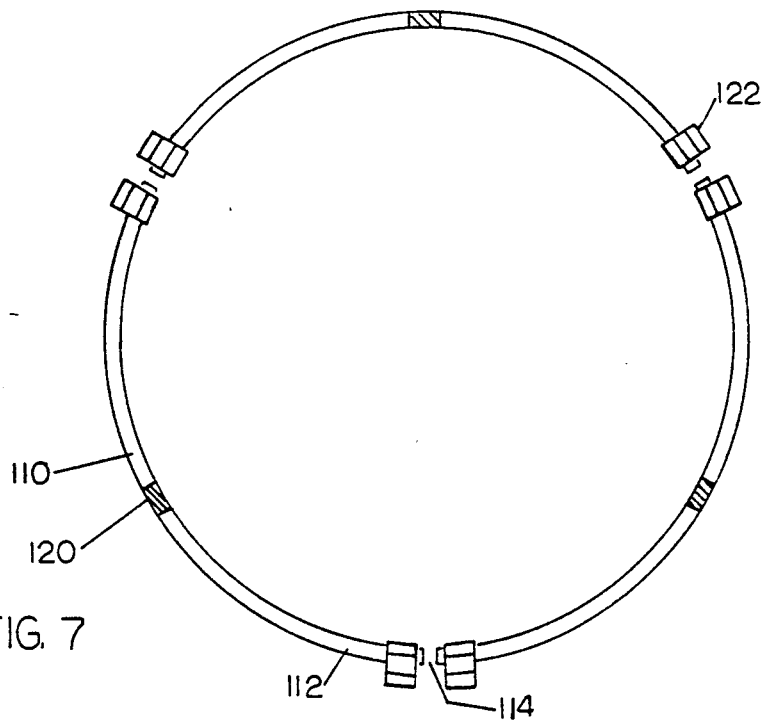
FIG. 7 is a section view at plane 7—7 of the finding-/latching mechanism of FIG. 6.

Referring now to FIGS. 2, 6, and 7, the finding/latching means 40 of the present invention incorporates a plurality of expanding semi-independent spring panels or gates 112 and keys 122 for finding the location of profile 28 in outer casing 26 within the well. The finding/latching means 40 includes a latch or spring tube 110 incorporating a specified pattern of circumferential and axial slots in the mid-section of tube 110 forming a plurality of integral gates 112 circumferentially spaced around spring tube 110. The slot pattern includes a generally U-shaped aperture 114 cut in the body of spring tube 110 to form a flexible gate 112 used as a circumferentially directed cantilever beam type spring. There are preferably three pairs of gates 112 with each pair of gates 112 having a common integral side forming a support base 120. By placing gates 112 back-to-back, the support base 120 serves two gates such that the operation of gates 112 causes opposite bending moments at support base 120 allowing sturdier gates and thus increasing the spring force of each gate 112 for locating and latching in profile 28. A relatively slender finder key 122 is attached at each free end 124 of gates 112 preferably by bolting 126. Bolt holes are provided at the circumferential ends of the gates 112 to receive bolts 126. Keys 122 have threaded bores on their internal surface for receiving socket low-head bolts 126. An alternative attachment means may be welding. Key 122 also includes upper and lower inwardly directed lips 136, 137 which are received within the U-shaped aperture 114. Upper and lower lips 136, 137 on the inside of keys 122 are provided for vertical location and for transmitting vertical loads between the spring tube 110 and the finder keys 122. The upper lip 136 also allows hanger lugs 60 to radially trap the finder keys 122 once keys 122 are expanded into the receiving recesses of profile 28.

Referring now to FIGS. 1-3, each key 122 has a profile which projects radially outward for engagement with latching shoulder 42 on outer casing 26. Each key 122 includes a lower downwardly facing and inwardly tapering lower end 128 for camming (he key 122 and thus the gate 112 radially inwardly as the key 122 makes engagement during its downward descent within outer casing 26. An upper radially extending tooth 131 is provided at the upper end of key 122 and forms a hook slot 130. Hook slot 130 includes a downwardly facing shoulder 132 and an upwardly facing downwardly tapering Cam surface 134. Hook slot 130 is dimensioned so as to receive shoulder 42 of profile 28 on outer casing 26. The tooth 131 holds the finder keys 122 once location has been achieved. The bottom surface 132 of the tooth 131 has an angle of 15° from horizontal for mating with a matching receiving recess in profile 28. The wedge effect of the 15° angle will not be sufficient to cause the finder key 122 to pass the mating surface in profile 28 prior to unlatching the spring tube 110. The 15° angle provides a vertical ramp for all of the teeth 131 not yet in position so that they may become wedged into the latched position.

The outer diameter of the main body 123 of key 122 is greater than the outer surface 129 of tooth 131 so that the main body 123 will engage the inner diameter of the outer casing string as the hanger assembly is lowered into the well and prevent the teeth 131 of keys 12 from prematurely hanging up in the well. The outer diameter of the main body 123 is intended to rub the outer casing bore as the hanger 20 is lowered into the outer casing 26. Since long recesses of "4" or more are not common features in casing strings or wellhead components, the keys are designed so that they will only be able to expand into a receiving recess which is about 4 in length for the purpose of latch-in. The tapering lower end 128 features a 15° angle from vertical to allow the key 122 to gently traverse internal geometry upsets in the casing bore including the internal low teeth, and to allow the keys 122 to be inserted into the wellhead without causing the spring tube 110 to unlatch. The outer surface of the main body 123 has a straight section of sufficient length, nominally 4 inches, to prevent gates 112 from expanding prematurely in some other recess in the string other than profile 28. As the proper location is found, the spring gates 112 force the individual keys 122 radially outward into the enlarged diameter portion 44 of outer casing 26.

The upper surface of lip 136 has an angle of 30° from horizontal while the outer teeth 131 have an angle of 30° from vertical. The inner angle of lip 136 mates with lugs 60 while the outer angle of teeth 131 facilitates retraction of the finder keys 122 in the unlatching sequence and during upward travel within outer casing 26.

The gates 112 are machined in the normal position of spring tube 110 as shown in FIG. 7, i.e. the radius of gates 112 is the same as that of continuous ring portions 138, 140, and are then contracted or bent inward at support base 120 upon insertion into the outer casing for lowering into position. Gates 112 will expand to the "out" position as desired and latch with outer casing 26 upon reaching a recess, such as enlarged diameter portion 44 for lowering into position. In the out position, the gates 112 only return to approximately 80% of the contracted distance of the gates 112 in the "in" position. By not permitting the gates 112 to fully expand back to the normal position shown in FIG. 7, gates 112 maintain a remaining residual spring force of the keys 122 into profile 28. The advantage of this arrangement is that finding/latching means 40 will latch if any one of the plurality of gates 112 expands to the out position, thus overcoming the problem of "junk" in the profile 28 of outer casing 26.

Referring now to FIGS. 2 and 6, the spring tube 110 forms a cage for the gates 112. The U-shaped apertures 114 form upper and lower continuous ring portions 138, 140, respectively, on spring tube 110 with the respective support bases 120 extending therebetween. Ring portions 138, 140 support gates 112. Upper ring portion 138 includes a plurality of evenly spaced notches 142 aligned with each pair of keys 122 and adapted for receiving alignment lugs 60 projecting from reduced diameter portion 50 on hanger 20. The notched upper ring portion 138 on the spring tube 110 receives the projecting alignment portion 61 of lugs 60 to index the keys 122 with lugs 60. This facilitates the proper interaction of the keys 122 and lugs 60. The upper continuous ring 138 slidingly engages and is supported by the bearing support surface 63 of lugs 60. Lugs 60 prevent the finder keys 122 from moving upward until keys 122 expand into mating profile 28, thereby preventing activation of load transfer ring 70. In the engaged position shown in FIG. 1, the bearing support surface 63 serves as a backup to keys 122 in their out or expanded position. By lugs 60 backing up finder keys 122 after latch-in, keys 122 are prevented from moving radially inward until hanger 20 is unlatched by pulling up to provide a proper unlatching sequence.

The upper terminal end 143 of spring tube 110 includes an upwardly facing downwardly tapering wedge surface 144 therearound adapted for engagement with the downwardly facing wedge surface 104 of load transfer ring 70. The wedging angle of wedge surface 144 of the spring tube 110 interfaces with the matching wedge angle provided by wedge surface 104 of the load transfer ring 70. The wedge surface 144 is cut on the top surface 143 to activate the load bearing elements 90. Actuation of the spring tube 110 from below drives the load bearing elements 90 outward. The actuation wedge surface 144 provides a full backup to prevent the teeth 100 from disengaging.

The spring tube 110 also includes a plurality of spring fingers 150 integral with and extending downwardly from lower continuous ring portion 140. The continuous lower ring portion 140 supports the lower cantilevered fingers 150. Fingers 150 are formed by a plurality of slots 152 circumferentially spaced below lower ring 140. Slots 152 extend from the bottom of tube 110 to allow for full flowby area in the annulus between tube 110 and hanger 20. Threaded holes 153 are provided in fingers 150 for use with a tool to expand fingers 150 for installing tube 110. The slots 152, provided in the lower end of the spring tube 110, between fingers 150 provide two functions. First, slots 152 are sized so that the desired flow-by area is achieved, allowing fluid flow into the annulus formed between the inside diameter of the spring tube 110 and the outside diameter of reduced diameter portion 50 of inner hanger 20. Second, slots 152 form the series of cantilever spring fingers 150.

Fingers 150 include a downwardly facing inwardly tapering surface 154 which acts as a guide surface to prevent the hanger 20 from prematurely hanging up in the internal diameter of outer casing 26 as the spring tube 110 moves downwardly within outer casing 26. Each finger 150 also includes a tooth 156 extending radially inward to be received in the lower groove 68 of hanger 20 below reduced diameter portion 50. The upper edge of lower groove 68 features a 50° interface angle that mates with a matching angle at 155 in the inside of teeth 156. Due to the radial interference of the two surfaces, a positive vertical force must be exerted on the spring tube 110 to allow upward travel of spring tube 110. Circumferentially continuous lower ring 140 separates the fingers 150 and the gates 112. There are no handling problems since the top continuous ring 138 and fingers 150 fit the hanger 20 closely to support the spring tube 110 on the hanger 20.

It is essential that the latching-in sequence be prevented prior to actually finding the proper location. Latching-in must not be initiated prematurely by friction force or by bridging across other internal features of the outer casing string. To accomplish this objective, the radially interfering tooth 156 at the lower end of the spring tube 110 mates with the receiving groove 68 in the inner hanger 20. The engagement of teeth 156 in groove 68 is greater than the anticipated friction force. The principle objective of the tooth/beam arrangement is to axially restrain the spring tube 110 until a predefined axial load is achieved. Once this load is exceeded, the radial wedging force at 155 will deflect the tooth 156 outward, thereby allowing axial movement of the spring tube 110 to occur with respect to the load transfer ring 70. This is a simple and highly controlled motion providing significant advantage.

The present invention is more reliable than that of the prior art because (1) even if one or several areas of the profile 28 are contaminated, at least one key 122 will find location and initiate the latching-in sequence resulting in the expansion of the load transfer ring 70, and (2) since each key 122 is relatively slender, the spring force is concentrated which results in a relatively high contact pressure as opposed to a single split ring. Higher contact pressure is more effective at penetrating or dislodging contamination.

Figure 8:
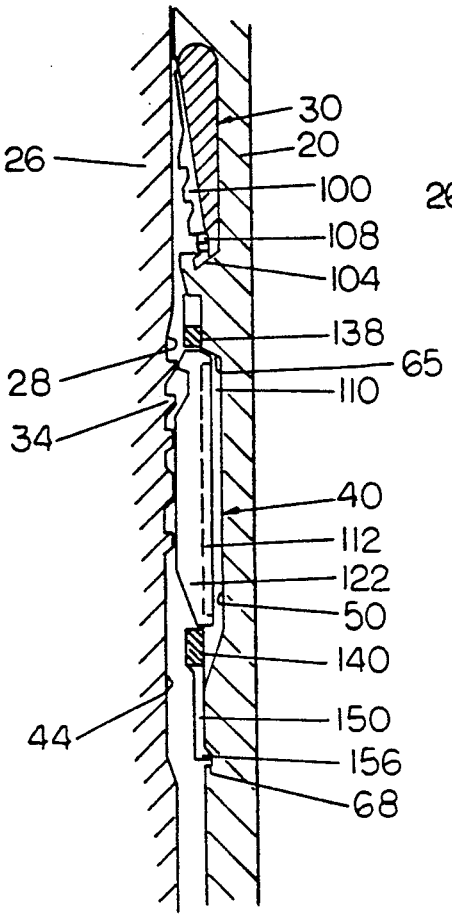
FIG. 8 is a sequence view of the inner hanger and outer casing as the inner hanger is run into the well.

Referring now to FIG. 8, in operation, the inner hanger 20 is inserted into the top of the outer casing string with tooth 156 of fingers 150 inserted into groove 68. Finder keys 122 are deflected radially inwardly. Taper 128 is provided on the bottom of keys 122 to bias them inwardly. The hanger 20 is lowered into the outer casing string. During this event, the circumferential beam spring gates 112 force keys 122 to rub along the internal wall 27 of the outer casing string, thereby producing an axial friction force on the spring tube 110. The axial restraining force of the teeth 156 in groove 68 must exceed this friction force. The lower downwardly facing cam surface 65 of lugs 60 will not engage upwardly facing surface 133 of keys 122 while fingers 150 are received in lower groove 68 of hanger 20. However, should teeth 131 of keys 122 prematurely hang within the casing string, cam surface 65 of lug 60 will apply a downward force on keys 122 to prevent further upward motion of spring tube 110 thereby preventing actuation of load ring 70. Further, should only a few of the keys 122 find location and latch into profile 28, cam surface 65 will apply an additional wedging force to cam surface 133 to force the unlatched keys 122 into profile 28.

Figure 9:
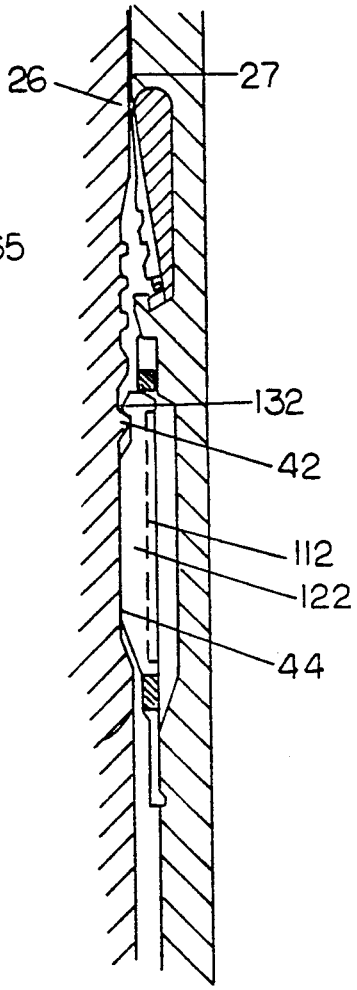
FIG. 9 is another sequence view of the inner hanger and outer casing with the inner hanger having been located within the outer casing.

Referring now to FIG. 9, the finding/latching means 40 finds location upon the keys 122 of gates 112 finding enlarged diameter portion 44 of outer casing 26. The keys 122, driven by the spring force of the circumferential beams of gates 112, expand into the enlarged diameter portion 44. The upper hooking shoulder 132 provided on keys 122 lands on the annular latching shoulder 42. The weight of the casing string being lowered will continue to pull down on hanger 20. At this point, the axial force required to radially displace the gates 112 and keys 122 inward once again must exceed the axial restraining force of the lower fingers 150 such that the further downward movement of the hanger will cause the teeth 156 of fingers 150 to expand outward and release. Once the restraining force is exceeded, the radial wedging force from the wedging surface 144 engaging wedging surface 104 will force the lower teeth 156 to expand to the point that the teeth 156 are forced out of groove 68, thereby allowing upward axial motion of the entire spring tube 110 relative to load transfer ring 70 on hanger 20. Should any gates 112 fail to expand such as due to contamination, the downwardly facing cam surface 65 of lugs 60 assists the expansion of any unexpanded gates 112 by engaging upper tapered surface 133 on the top of keys 122 to Cam gates 122 outwardly.

Figure 10:
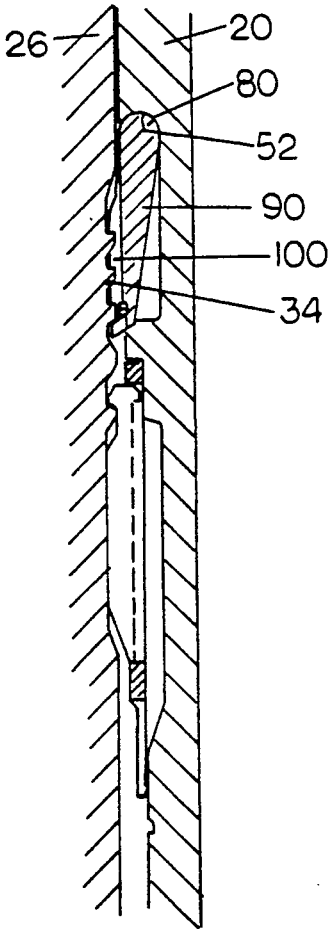
FIG. 10 is a later sequence view of the inner hanger assembly latched into the outer casing.

Referring now to FIG. 10, after a predetermined upward relative motion of spring tube 110 has occurred, the finding/latching means 40 engages lower wedging surface 104 camming lower terminal end 82 outward against spring retainer means 108. The wedging surface 144 at the top of spring tube 110 will engage the lower end 82 of wedge surface 104 on the load transfer ring 70 and cam the teeth 100 of load bearing elements 90 into engagement with the teeth 34 of profile 28 in the outer casing 26. The bearing support surface 63 of lugs 60 moves behind upper radial projecting surface of keys 122 to maintain them in the "out" position. The finding/latching means 40 becomes an actuation means. Load bearing elements 90 rotates and pivots outwardly as convex shoulder 80 articulates within downwardly facing concave shoulder 52. Upwardly facing convex shoulder 80 does not move radially but articulates in concave shoulder 52 until teeth 34, 100 engage. The vertical height of the ring 70 is such that the radial translation required to form the connection results from an angular rotation or pivoting about the center of the upper convex radius. The radial expansion of a particular portion of load bearing elements 90 is proportional to the distance it is located from the center of the convex shoulder 80. The partial slits 78 from the bottom surface 82 to near the top of shoulder 80 of ring 70 allow the differential radial expansion to occur. This simple motion leads to high latching reliability.

A principle advantage of the present invention is that the upper end of the load bearing elements 90 rotates about the center of convex shoulder 80 and does not translate radially. The shoulders 36, 96 form a bearing or load transfer area, i.e. "contact patch". The present invention eliminates the radial translation of the load transfer means 30 at the "contact patch" between the load transfer means 30 and the outer casing 26. All radial sliding translation at the interface between the load transfer ring 70 and the mating profile 28 of outer casing 26 is eliminated, thereby allowing the limited amount of radial space to be used solely for load bearing and flow-by area independent of the radial translation. Thus, all available annular area can be utilized for flow-by area or load bearing. Additionally, since such radial translation space is not a factor, both flow-by area and load bearing capacity may be increased above the levels achieved by the prior art.

Removing the inner hanger 20 is the reverse of the above process.

It should be understood that the load transfer means 30 and the finding/latching means 40 may be used independently without the other. For example, the load transfer means 30 could be used with an existing prior art latching mechanism such as a C-ring or colleted ring.

While a preferred embodiment of the invention has been shown and described, modifications thereof can be made by one skilled in the art without departing from the spirit of the invention.

I claim:

1. A hanger assembly for transferring the load from the hanger to an outer casing, comprising:

a tubular hanger having a downwardly facing bearing surface;

a load transfer ring having an upwardly facing bearing surface for mating engagement with said downwardly facing bearing surface;

said load transfer ring having a plurality of load bearing elements extending downwardly from said upwardly facing bearing surface;

said load bearing elements having at least one external tooth whereby upon articulating said upwardly facing bearing surface on said downwardly facing bearing surface, said teeth rotate outwardly and engage the outer casing.

2. The hanger assembly of claim 1 further including means for biasing said load bearing elements inwardly.

3. The hanger assembly of claim further including alignment means for aligning said load transfer ring on said hanger.

4. The hanger assembly of claim 1 further including means for camming said load bearing elements such that said upwardly facing bearing surface articulates on said downwardly facing bearing surface.

5. The hanger assembly of claim 1 further including means for locating the outer casing and latching therewith.

6. The hanger assembly of claim 5 wherein said means includes latches which swing horizontally outward into engagement with the outer casing.

7. The hanger assembly of claim 6 wherein said latches include an integral support base on said hanger.

8. The hanger assembly of claim 6 wherein said latches include keys for engaging the outer casing.

9. The hanger assembly of claim 5 wherein said means includes fingers received by an annular groove in said hanger.

10. An apparatus for latching a hanger in an outer casing, comprising:

a tubular body disposed around the hanger;

a plurality of I-shaped slot patterns in the sides of said body forming sets of spring members;

said sets of spring members each having a free end and an opposite end integral with said side of said body forming a support base;

said free ends of each set being adjacent each other and rotating in opposite directions upon expansion outwardly;

each spring member of a set being unrestrained and adapted to be held in a contracted position by engagement with the outer casing upon passage therethrough; and a key disposed on each of said free ends adapted for latching the outer casing.

11. An apparatus for latching a hanger in an outer casing, comprising:

a tubular body disposed around the hanger;

a slot pattern in the sides of said body forming at least one spring member;

said spring member having a free end and an opposite end integral with said side of said body forming a support base;

said spring member being unrestrained and adapted to be held in a contracted position by engagement with the outer casing upon passage therethrough;

a key disposed on said free end adapted for latching the outer casing; and said key including a shoulder for latching engagement with the outer casing and a bearing area adapted to engage the outer casing to hold said spring member in said contracted position.

12. An apparatus for latching a hanger in an outer casing, comprising:

a tubular body disposed around the hanger;

a slot pattern in the sides of said body forming at least one spring member;

said spring member having a free end and an opposite end integral with said side of said body forming a support base;

said spring member being unrestrained and adapted to be held in a contracted position by engagement with the outer casing upon passage therethrough;

a key disposed on said free end adapted for latching the outer casing; and said tubular body including at least one pair of spring members having a common base whose axis is parallel to the flow axis of said tubular body.

13. An apparatus for latching a hanger in an outer casing, comprising:

a tubular body disposed around the hanger;

a slot pattern in the sides of said body forming at least one spring member;

said spring member having a free end and an opposite end integral with said side of said body forming a support base;

said spring member being unrestrained and adapted to be held in a contracted position by engagement with the outer casing upon passage therethrough;

a key disposed on said free end adapted for latching the outer casing; and said free end of said spring member moving relative to said support base from a contracted position to an expanded position in engagement with the outer casing and transversely to the flow axis of the outer casing.

14. A mudline suspension system, comprising:

a casing having an annular profile forming a plurality of radially extending teeth and a radially extending latch shoulder;

a hanger having a reduced diameter portion for housing a load transfer ring and a latching spring tube and having a downwardly facing concave annular shoulder;

said load transfer ring having an upwardly facing convex annular shoulder for mating engagement with said concave annular shoulder;

said load transfer ring having a plurality of load bearing elements extending downwardly from said convex annular shoulder;

said load bearing elements having at least one external tooth whereby upon articulating said convex annular shoulder on said concave annular shoulder, said teeth rotate outwardly and engage said profile on said casing;

said spring tube having a tubular body disposed around said reduced diameter portion of said hanger;

a slot pattern in the side of said body forming at least one spring member;

said spring member having a free end and an opposite end integral with said side of said body forming a support base; and a key disposed on said free end adapted for latching with said latch shoulder whereby said load transfer ring moves downwardly with respect to said spring tube and said spring tube engages said load bearing elements causing said external tooth to engage said profile on said casing.

15. A hanger assembly for suspending a string of pipe within an outer casing comprising:

a generally tubular hanger having a reduced diameter portion with a downwardly facing concave annular shoulder and a plurality of circumferentially spaced lugs projecting radially from said reduced diameter portion;

a load transfer means disposed in said reduced diameter portion for transferring the load from said hanger to the outer casing;

said load transfer means including a load transfer ring and a spring retainer;

said load transfer ring having an upwardly facing annular convex shoulder engaging said downwardly facing concave shoulder on said hanger and a plurality of load bearing elements extending downwardly from said convex shoulder, said load bearing elements having a plurality of downwardly facing teeth;

said load transfer ring having a plurality of slots for receiving said lugs and an annular groove adjacent its lower terminus for receiving said spring retainer, said lugs axially locating said load transfer ring on said hanger and said spring retainer biasing said load bearing elements radially inward into said reduced diameter portion;

a finding/latching means disposed in said reduced diameter portion below said load transfer means for finding the outer casing and latching said hanger within the outer casing;

said finding/latching means including a spring tube having a plurality of integral gates circumferentially disposed therearound and a plurality of fingers extending downwardly from the lower end of said spring tube;

said gates formed by generally U-shaped apertures through the tubular sides of said spring tube with that portion of said gates integral with said spring tube forming support bases for said gates;

a key disposed on each of said gates opposite said support base;

a plurality of notches disposed in the upper periphery of said spring tube receiving said lugs for indexing said keys with said lugs;

each of said fingers having at least one tooth for engaging a groove in said hanger; and said upper periphery forming a wedge angle for engaging said load transfer ring and rotating said teeth on said load bearing elements radially outward as said convex shoulder articulates on said concave shoulder.

16. A hanger received and supported within an outer casing, comprising:

a tubular body having an outer diameter and a reduced diameter portion;

an annular latching member disposed within said reduced diameter portion around said tubular hanger body;

said latching member including a plurality of individual spring members;

each of said spring members being disposed in a non-actuated position within said reduced diameter portion;

said spring members each having a free end and an opposite end integral with said tubular body;

non-shearable retention means disposed on said free end of said spring members to maintain said spring members in a contracted position upon the passage of said tubular hanger body through said outer casing; and latch means disposed on said free ends of said spring members extending from said reduced diameter portion and beyond said outer diameter of said tubular hanger body and adapted for latching engagement with the outer casing.

17. The hanger of claim 16 wherein said latch means includes keys disposed on said free ends of said spring members, said keys extending beyond the outer diameter of said tubular hanger body.

18. The hanger of claim 17 wherein said keys individually move into latching engagement with the outer casing.

19. The hanger of claim 17 wherein said spring members are individually expandable to project said key on said free end of said spring member into latching engagement with the outer casing.

20. A hanger received and supported within an outer casing, comprising:

a tubular body having an outer diameter and a reduced diameter portion;

an annular latching member disposed within said reduced diameter portion around said tubing hanger body;

said latching member including a plurality of individual spring members;

said spring members being disposed in a non-actuated position within said reduced diameter portion;

latch means disposed on terminal ends of said spring members and projecting from said reduced diameter portion and adapted for engagement with the outer casing;

a plurality of load transfer elements adapted for engagement with the outer casing;

said load transfer elements being disposed within said reduced diameter portion and within the outer diameter of said tubular hanger body whereby said load transfer elements do not engage the outer casing until said latching member engages the outer casing and moves said load transfer elements into position for engagement with the outer casing.

21. A hanger assembly for transferring the load from the hanger assembly to an outer casing, comprising:

a tubular hanger having a downwardly facing bearing surface;

a load transfer member having an upwardly facing bearing surface for mating engagement with said downwardly facing bearing surface;

said load transfer member having a plurality of load bearing elements extending downwardly from said upwardly facing bearing surface; and said load bearing elements having at least one external tooth whereby upon articulating said upwardly facing bearing surface on said downwardly facing bearing surface, said teeth rotate outwardly and engage the outer casing.

22. A hanger assembly for transferring the load from the hanger assembly to an outer casing, comprising:

a tubular hanger having a plurality of downwardly facing bearing surfaces;

load transfer means having a plurality of load transfer members with upwardly facing bearing surfaces for mating engagement with said downwardly facing bearing surfaces;

said load transfer members extending downwardly from said upwardly facing bearing surfaces; and each of said load transfer members having at least one external tooth whereby upon articulating said upwardly facing bearing surfaces on said downwardly facing bearing surfaces, said teeth rotate outwardly and engage the outer casing.

* * * * *